United States Patent [19]

Subramanian et al.

[11] Patent Number: 4,673,490

[45] Date of Patent: Jun. 16, 1987

[54] PROCESS FOR SEPARATING CRUDE OIL COMPONENTS

[75] Inventors: Mahadevan Subramanian; Richard D. Monday; David B. Johnson, all of Houston, Tex.; Frank J. Kleinschrodt, Herring Cove, Canada

[73] Assignee: Fluor Corporation, Irvine, Calif.

[21] Appl. No.: 768,615

[22] Filed: Aug. 23, 1985

[51] Int. Cl.[4] ..... C10G 7/00; B01D 3/42

[52] U.S. Cl. ..... 208/354; 208/356

[58] Field of Search ..... 208/351, 354, 356, 357, 208/358, 364

[56] References Cited

U.S. PATENT DOCUMENTS

| | | | |
|---|---|---|---|
| 1,939,633 | 12/1933 | Roberts | 208/354 |
| 2,773,559 | 12/1956 | Cottle | 208/351 |
| 3,210,271 | 10/1965 | Byerly et al. | 208/356 |
| 3,297,566 | 1/1967 | Moyer et al. | 208/364 |
| 3,301,778 | 1/1967 | Cabbage | 208/356 |
| 3,320,159 | 5/1967 | Potts | 208/358 |
| 3,567,628 | 3/1971 | Van Pool | 208/356 X |
| 4,191,640 | 3/1980 | Chess et al. | 208/357 X |

*Primary Examiner*—Andrew H. Metz
*Assistant Examiner*—Glenn A. Caldarola
*Attorney, Agent, or Firm*—Lyon & Lyon

[57] ABSTRACT

A more effective and efficient method for separating the components of crude oil, particularly off-gases and LSR naphtha and heavy naphtha, is disclosed. The crude oil is heated and fed to a prefractionator that operates at relatively high pressure and uses a multiple condenser-/accumulator overhead system for collecting and separating off-gases and LSR naphtha while avoiding the problems of water condensation in the top section of the prefractionator and the need to compress overhead vapors to fuel gas system pressure. After heating, the bottoms from the prefractionator are fed to an atmospheric crude tower to recover desirable components such as diesel, kerosene, atmospheric gas oils and reduced crude. The overheads of such crude tower are processed through a set of overhead condensers/accumulators for collecting the small amounts of naphtha and sending them to a naphtha stripper column for further recovery and purification.

11 Claims, 1 Drawing Figure

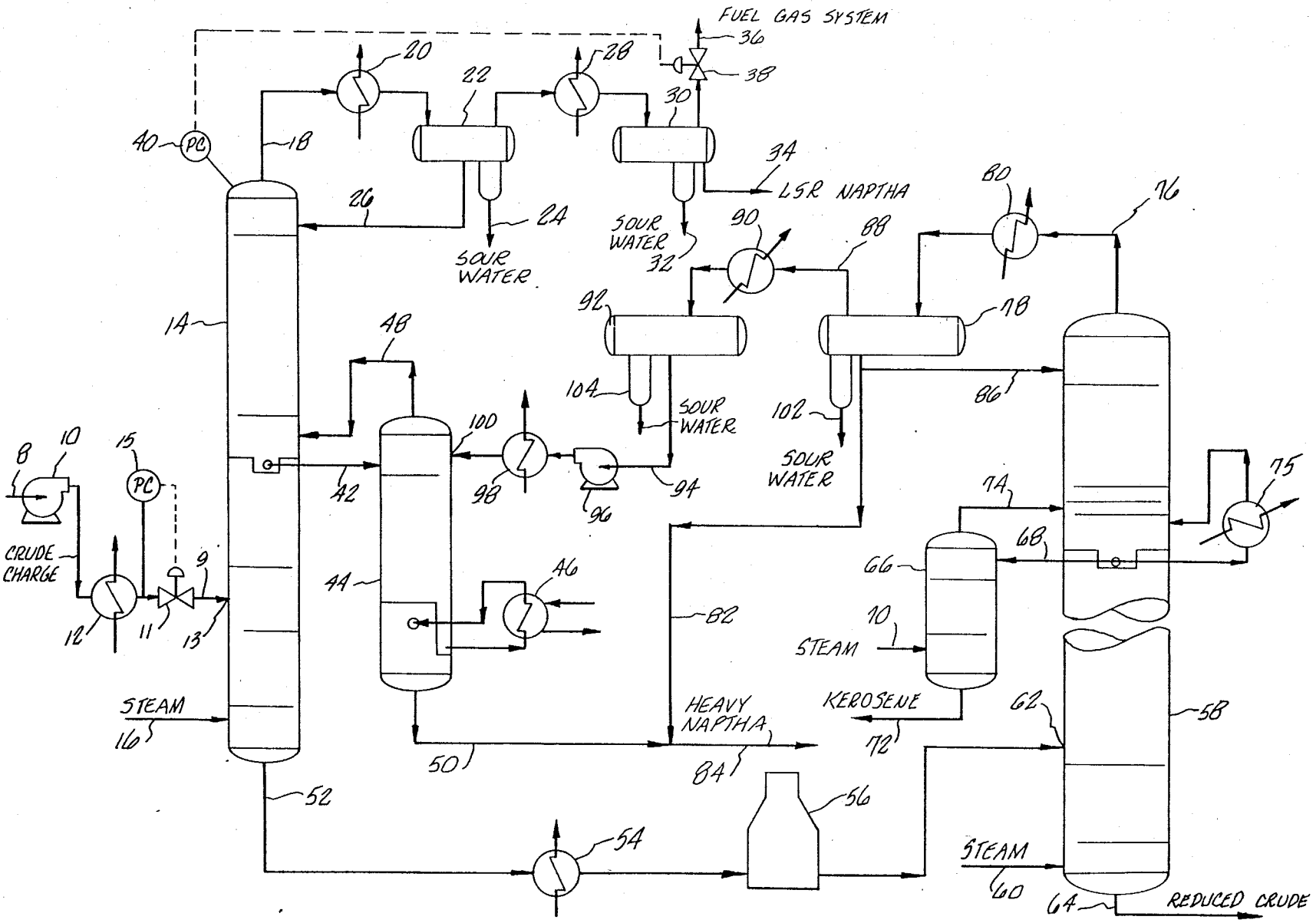
FUEL GAS SYSTEM
LSR NAPTHA
SOUR WATER
HEAVY NAPTHA
KEROSENE
STEAM
REDUCED CRUDE
CRUDE CHARGE
PC

PROCESS FOR SEPARATING CRUDE OIL COMPONENTS

FIELD OF THE INVENTION

This invention relates generally as indicated to a process for separating crude oil components, and more particularly to such a process in which a pefractionation system operating at relatively high pressure is used to separate essentially all the not readily condensable components and naphtha components from the crude oil charge prior to using an atmospheric crude distillation unit for separating the remaining crude oil components.

BACKGROUND OF THE INVENTION

Conventional so-called atmospheric crude distillation units used for separating the desirable components of crude oil typically have an atmospheric crude tower, a naphtha splitter or naphtha stripper to separate the straight run naphtha into light straight run (LSR) naphtha and heavy naphtha, and several side strippers to produce components such as diesel, kerosene, and atmospheric gas oil. Traditionally, such atmospheric crude distillation units operate at near atmospheric pressure in order to evaporate all desirable components without exceeding cracking temperatures in the bottom of the crude distillation tower. This has led to the auxiliaries around the crude distillation tower being operated at about the same pressure as well.

In units of this type, the overhead product of the atmospheric crude tower either is a full range naphtha which is subsequently split into an LSR naphtha and a heavy straight run naphtha in a naphtha splitter, or the LSR naphtha is recovered as an overhead product of the atmospheric crude tower and the heavy naphtha is produced as the bottom product of a naphtha side-stripper connected to the atmospheric crude tower.

In both types of operation described above, low temperatures in the top section of the atmospheric crude tower may result in water condensation on the upper trays. This condensed water can be very corrosive because the separated water will typically contain $H_2S$ and other sulfur compounds obtained from the crude oil. Hence, special metallurgy is required for the tower internals such as linings and trays and the overhead condensing system. In addition, special tray types have to be used for withdrawing water from the trays, and in the presence of water the fractionation efficiency of the tower may decrease as well.

Previously known crude separation systems may include a preflash tower upstream of the atmospheric crude tower removing most of the not readily condensible components present in the crude oil charge, thereby reducing the load on the atmospheric crude tower. Such preflash towers typically operate at pressure of less than 25 psig.

Since all of these prior art methods operate at a relatively low pressure, any off-gases collected from the overhead system have to be compressed, since refinery fuel gas systems generally operate at a much higher pressure (usually higher than 50 psig). Compressing any substantial amount of gas consumes a high amount of energy.

Accordingly, there exists a need for a crude oil component separation method that will separate not readily condensable components at a sufficiently high pressure to eliminate the need for an off-compressor and that will effectively and efficiently separate light and heavy naphtha components and other crude oil components while avoiding the problems of water condensation in the top of the distillation tower and the corrosion caused thereby.

SUMMARY OF THE INVENTION

The present invention involves a process for separating the desirable components of crude oil that eliminates the off-gas compressor, separates the naphtha components more effectively and efficiently, does not suffer from the problems associated with water condensation and reduces the overall energy requirements. One of the primary innovations of the present invention is that a prefractionator is used that operates at relatively high pressure, which serves to facilitate achieving the goals discussed above. The crude oil feed is pumped, heated and then fed to a prefractionator, which operates with a flash zone pressure within the range of approximately 50 to about 100 psig. The not readily condensible components as well as the LSR naphtha are taken as overhead products of the prefractionator. The top section of the high pressure prefractionator is hotter than in conventional low pressure preflash systems and atmospheric crude towers and hence water condensation does not take place in the top section of this tower.

The overhead stream from the prefractionator is further processed to separate sour water, LSR naphtha, and not-readily condensible components. An intermediate naphtha side cut is withdrawn from the prefractionator and striped is a reboiled side-stripper to yield a heavy naphtha product. The bottoms stream from the prefractionator is heated and sent to an atmospheric crude tower and further processed to separate kerosene, diesel, atmospheric gas oils, reduced crude and small amounts of naphtha remaining in the bottoms stream in the high pressure prefractionator.

By utilizing the method of the present invention the load of the atmospheric crude tower is reduced considerably, resulting in a marked reduction in the diameter and height of that tower as well as a reduction in the duty of the heater required to heat the bottoms stream from the prefractionator prior to feeding it to the flash-zone of the atmospheric crude tower. Furthermore, the separation of the LSR and heavy naphtha fractions is accomplished more effectively and more efficiently because the reflux requirements of the atmospheric crude tower have been reduced, the use of a naphtha splitter with its inherent extra condensing, vaporizing and recondensing stages is avoided, the condensation of water in the top sections of the prefractionator and atmospheric crude towers has been avoided, and therefore the need for corrosion-resistant tower internals, such as linings and water draw-off trays, has been eliminated, and because there is no need for an off-gas compressor.

These and further objects and advantages will be apparent to those skilled in the art in connection with the detailed description of the invention that follows.

BRIEF DESCRIPTION OF THE DRAWING

FIG. 1 is a schematic diagram illustrating the crude oil component separation method of the present invention.

DETAILED DESCRIPTION OF THE PREFERRED EMBODIMENT

In accordance with the method of the present invention, the components of crude oil are separated to produce streams of non-readily condensible compounds, LSR naphtha, heavy naphtha, and heavier compounds such as diesel, kerosene, atmospheric gas oils and reduced crude. The crude oil feed may consist of any of the various mixtures of petroleum components that may be found in any type of crude oil.

FIG. 1 illustrates schematically the typical design of the method of the present invention. A crude oil feed stream 8 is pumped in a crude oil feed pump 10 to a relatively high pressure. The pressure will preferably be set such that any off-gases ultimately obtained using the method of this invention will be obtained at a pressure equal to or higher than the pressure of a fuel gas system located downstream. By establishing pressures throughout the system in accordance with this object, the need for an off-gas compressor is eliminated. The elimination of an off-gas compressor leads to a substantial energy saving because the incremental energy required to pump the liquid crude oil charge feed stream 8 is substantially less than the energy required to compress the off-gases after separation.

After the crude oil feed stream 8 is pumped, it is heated to a relatively high temperature using one or more heat exchangers 12 exchanging heat with one or more hot crude oil components. Typically, several heat exchangers 12 will be used. It should be noted that a fired heater can be substituted and/or added for any or all of the heat exchangers 12 and also that the method of the present invention is not affected by the scheme used to perform the heating step nor by performing the heating step prior to the pumping step.

If the crude oil feed stream 8 contains an overabundance of volatile gases, it may be preferable to remove a portion or all of such gases prior to feeding the crude oil into the high pressure prefractionator. A typical way to do this is to use a flash drum after a heating step to separate the more volatile gases as a vapor while retaining the less volatile component as a liquid. In general, however, the process of the present invention seeks to suppress vaporization during the initial heat up and pumping stages by means of a back pressure control valve 11 operated by a pressure control sensor 15 located immediately upstream of the prefractionator.

The pumped and heated crude oil feed stream 9 is then fed to a prefractionator 14 at an inlet 13. The prefractionator 14 can be any of conventional types of distillation towers designed to accommodate the operating conditions of such a prefractionator. The prefractionator 14 is provided with stripping steam 16 at a point below the crude oil feed stream inlet 13.

In addition to, or instead of, exchangers 12 (or the optional fired heater), it is also possible, although not necessary, to utilize a fired reboiler located below the crude oil feed stream inlet 13 at the bottom of the prefractionator 14. The use of a feed heater and/or a reboiler will generally not be necessary unless the crude oil feed stream 8 has a larger than normal portion of naphtha components. The crude oil feed stream 8 normally will contain 20 to 30 percent naphtha. If, however, there is an abnormally high naphtha content in the crude oil feedstream 8, there may not be enough heat exchanged in the heat exchangers 12 to heat the crude oil feedstream 8 to a temperature high enough to allow most of the naphtha components to vaporize upon being fed to the prefractionator 14. This additional heat could be provided by the prefractionator fired heater or alternatively by a prefractionator reboiler. The duty requirements of the reboiler or of the feed heater could be obtained, either alone or together, by means of an additional coil or coils in the downstream atmospheric tower feed heater 56 (discussed below), or, if the requirements are sufficiently large, by a separate heater.

The prefractionator 14, in accordance with the pressure objective discussed above, will typically operate within a range of about 50 to about 100 psig with a preferred range being about 75 to 85 psig.

The prefractionator 14 has an overhead stream 18 which passes through one or more partial condensers 20 before being fed to an accumulator 22. The partial condenser or condensers and accumulator form a partial condensing unit. The accumulator 22 is a standard drum that also has means for separating sour water from the liquid petroleum condensate. Sour water is removed as a stream 24 and the liquid petroleum condensate from the accumulator 22 is refluxed to the top of the prefractionator 14 in a stream 26. The sour water condensed out contains hydrogen sulfide and other sulfur compounds that would be corrosive to the prefractionator 14 if present there in liquid form. The operating pressure of the prefractionator 14 and the operating temperature and pressure of the crude oil feed stream 9 being fed to the crude oil feed stream inlet 13 determine the amount of hydrocarbon vapor leaving the prefractionator 14 in stream 18 and the partial pressure of the water vapor present in that overhead stream. The outlet temperature of partial condenser 20 can be controlled to produce a difference of at least 5° F. between the water dew point of the vapor from the top tray of the prefractionator 14 and the returning reflux 26, the latter having the higher temperature. Due to this temperature control, no water condenses in the prefractionator 14. Thus, there is no need to design the internals of the prefractionator 14, such as linings and trays, with any special metallurgy, nor is there any requirement for special tray types for withdrawing water from the trays. The absence of any liquid water phase in the prefractionator 14 also improves the fractionation efficiency of the distillation process.

The vapor that is not condensed in the partial condenser or condensers 20, due to the temperature requirements needed to avoid any water condensation in the prefractionator 14, is fed through a second set of one or more partial condensers 28 to a second accumulator 30. This accumulator 30 is similar to the first accumulator 22 in that it has a means for separating out sour water in a stream 32. The remaining liquid condensed is LSR naphtha and can be collected in a stream 34 that will meet the stringent ASTM specifications for LSR naphtha. Vapors not condensed in the second partial condenser or condensers 28 will consist of non-readily condensible compounds that may be used as fuel gas. These vapors can be fed to a fuel gas system in a stream 36.

Stream 36 is controlled by a pressure control valve 38 that can be any of a wide variety of standard pressure control devices. This pressure valve 38 will be controlled by a pressure control sensor 40 that measures the pressure in the top section of the prefractionator 14. The pressure control sensor 40 responds to pressure changes within the prefractionator 14 and will cause the opening or closing of the pressure valve 38 to maintain the relatively high operating pressure throughout the system.

An intermediate side cut 42 is taken from the prefractionator 14 at a point above the crude oil feed stream inlet 13. This intermediate side cut 42 is fed to a naphtha stripper column 44. The naphtha stripper column 44 is a stripper column provided with a reboiler 46 that may be operated either by heat exchange with other process streams or by a heater. The overhead from the naphtha stripper column 44 is returned to the prefractionator 14 in a stream 48. This vapor stream 48 will consist primarily of light components while the bottoms stream 50 of the naphtha stripper column 44 will contain heavy naphtha of such quality that it can meet the stringent ASTM specifications. The naphtha stripper column 44 is equipped with a reboiler 46 because stream stripping would introduce water vapor that could once again result in the aforementioned water condensation problem. The required duty of the naphtha stripper column reboiler 46 is a function of the number of trays in the naphtha stripper column 44, the side-stream feed composition and the specification of the heavy naphtha bottom product. In the preferred embodiment of the present invention, all of these interdependent variables are optimized.

If desired, more than one side-cut 42 may be taken from the prefractionator 14 without affecting the method of the present invention. The number of such side cuts will depend upon the operating conditions and the composition of the crude.

The bottoms stream 52 from the prefractionator 14 contains primarily crude oil components heavier than heavy naphtha with small amounts of heavy naphtha and even smaller amounts of light naphtha. It is heated by heat exchange in one or more crude preheat exchangers 54 and/or a crude heater 56 such that all of the desirable components to be collected are vaporized (the heater generally being required because of the high temperature required downstream). The stream is then fed to a low pressure atmospheric crude tower 58 at a stream inlet 62. The atmospheric crude tower 58 may be any of a variety of well known low pressure crude towers. The atmospheric crude tower 58 is provided with stripping steam 60 at a point lower than the stream inlet 62.

The bottoms stream 64 of the atmospheric crude tower 58 contains reduced crude oil, substantially free of naphtha, kerosene, diesel, atmospheric gas oils, or any of the lighter desirable components of crude oil. This bottoms stream 64 can be fed to a typical vacuum tower for further recovery of desirable heavy petroleum fractions.

The atmospheric crude tower 58 will typically operate at pressures ranging from about 5 to about 35 psig, resulting in a pressure of 5 to 15 psig in the second stage accumulator 92, discussed below, the minimum pressures required to ensure adequate operation of the system. The atmospheric crude tower 58 is usually equipped with a number of side-stream draw-off product strippers, of which a side cut kerosene stripper 66 as shown in FIG. 1 is a typical example. The side cut kerosene stripper 66 receives a side cut 68 from the atmospheric crude distillation tower 58 drawn-off from a point located above the bottoms stream inlet 62. The side cut kerosene stripper 6 is provided with stripping steam through line 70, and a bottoms stream 72 of kerosene product can be collected. The overhead stream 74 from the side cut kerosene stripper 66 is returned back to the atmospheric crude distillation tower 58 at a point higher than the side cut stream 68.

Typically, a pump around cooler 75 will be provided to remove heat and generate internal reflux in the atmospheric crude tower 58 in the vicinity of the kerosene stripper side cut 68. The heat removed in such a pump around cooler 75 is used to preheat the incoming crude oil feedstream 8. Typically, two or more additional side cuts and pump arounds can be taken below the kerosene side cut 68 and above the feed inlet 62 in a similar manner.

As mentioned above, a small part of the heavy naphtha and an even smaller part of the LSR naphtha tends to be dissolved and carried along in the bottoms stream 52 from the prefractionator 14. These components end up in the stream that is taken as overhead 76 in the atmospheric crude tower 58.

Rather than increasing the steam stripping rate in the prefractionator, a preferred embodiment of the present invention is to allow those small amounts of naphtha to be recovered in the atmospheric crude tower overhead system where the heavy naphtha fraction is separated from the overhead stream 76 in a first stage accumulator 78. The temperature in the first stage accumulator 78 is regulated by the use of one or more partial condensers 80 such that an LSR-free heavy naphtha condensate is produced in the first stage accumulator 78. This LSR-free heavy naphtha condensate can be collected in a stream 82 that may be combined with the bottom stream 50 from the naphtha stripper column 44 to form a combined heavy naphtha product stream 84. In a preferred embodiment, a portion of the heavy naphtha condensate stream 82 is refluxed to the atmospheric crude distillation tower 58 in a stream 86. It will be readily apparent to one of ordinary skill in the art, given the description and discussion herein, that it is not necessary to combine the heavy naphtha stream 82 with the bottoms stream 50 from the naphtha stripper column 44.

The naphtha components not condensed in the first stage partial condenser or condensers 80 leaves the first stage accumulator 78 as a vapor in stream 88. One or more condensers 90 regulate the temperature of this vapor stream 88 such that it is condensed and collected in a second stage accumulator 92. The condensed naphtha stream 94 leaves the second stage accumulator 92, is pumped in a pump 96 to a pressure somewhat higher than that of the naphtha stripper column 44, is heated in one or more heat exchangers 98 to its bubble point temperature, and is then fed to the top of the naphtha stripper column 44 at inlet 100. The first stage accumulator 78 and the second stage accumulator 92 will preferably have means for separating and removing sour water in streams 102 and 104 respectively.

In the naphtha stripper column 44, as discussed above, the LSR naphtha components are stripped out from the heavy naphtha, resulting in very good separation between the LSR naphtha and the heavy naphtha.

As an example of the typical operating conditions involved when a crude oil feed of typical composition is used, the conditions of the prefractionator 14 might vary from a pressure of approximately 75 psig and a temperature of 256° F. at the top tray to 80 psig and 494° F. at the bottom tray, with pressure slightly higher than 80 psig and a 513° F. temperature at the crude oil feed inlet. The temperature of the first accumulator 22 of the overhead of the prefractionator 14 may be 181° F. while the second accumulator 30 would operate at a pressure of 60 psig and a temperature of 100° F., thereby condensing out high quality LSR naphtha. It should be clear that the typical operating conditions discussed herein will vary depending upon the composition and type of crude charged to the system and upon various other conditions. The present example is only for illustration purposes.

The atmospheric crude tower 58 will typically operate at conditions of about 10 psig and 369° F. at the top tray to 15 psig and 722° F. at the bottom tray. A kerosene side cut stream 68 might be at 457° F. with the bottoms stream 72 from the side cut kerosene stripper 66 being at 440° F. The first stage accumulator 78 of the overhead from the atmospheric crude tower 58 may operate at a temperature of 218° F. while the second stage accumulator 92 would operate at a pressure of 2 psig and a temperature of 114° F. Typical temperatures for the naphtha stripper column 44 are 343° F. at the top tray and 393° F. at the bottom.

As can be seen, the advantages of utilizing the method of the present invention are numerous. The high pressure prefractionator design solves some of the problems and inefficiencies encountered in typical prior art designs. The high pressure prefractionator 14 enables the separation of the LSR naphtha from the heavy naphtha avoiding the use of a naphtha splitter, with its inherent condensing, vaporizing, and recondensing stages of naphtha components, and hence is more energy efficient. Other advantages of this design are that the vapor feed load to the atmospheric crude tower 58 and the reflux requirements to produce acceptable grades of LSR and heavy naphtha are reduced considerably. This means that the atmospheric crude tower 58 can be designed smaller in diameter and significantly shorter in height. The reduced load also means that the duty of the crude heater 56 can be significantly smaller. In addition, the naphtha stripper column 44 is smaller than the corresponding naphtha splitter of the prior art. The reduced size and heat duty of each of these items leads to both capital cost and energy savings.

The overhead systems designs of both the atmospheric crude tower 58 and the prefractionator 14 include multiple overhead accumulator/condensers. Advantages obtained from such a design are that water condensation can be avoided in the top sections of both of the towers and higher temperatures for the overhead condensers 20 and 80 can be utilized. The ability to use higher temperature overhead condensers gives the system more flexibility and allows for greater energy recovery.

While in some cases the incorporation of a high pressure prefractionator system may be initially more expensive in terms of capital investment cost than the conventional crude units, the substantial difference in energy efficiency will recover the additional initial cost very quickly. Since generally more heat is available at higher temperature levels and more heat is consumed at a lower temperature level, the total amount of recoverable heat will increase. As mentioned above, there is a reduced vaporization duty in the crude heater 56 due to the high exchange of heat available from the various petroleum components produced to the crude oil feed stream 8 and prefractionator bottoms stream 52.

Energy savings can also be realized downstream in that the higher bottoms temperature of the atmospheric crude tower 58 leads to reduced duty in the feed heater for the ensuing vacuum tower.

In addition to these energy savings are the major advantages of achieving a much sharper separation between the LSR and heavy naphtha, avoiding the need for an off-gas compressor and eliminating any special apparatus or procedures for coping with water condensation problems.

Having thus described the invention, it is to be understood that the invention is not limited to the embodiments described herein for purposes of exemplification, but it is to be limited only by the lawful scope of the attached claims, including a full range of equivalents to which each element thereof is entitled.

What is claimed is:

1. A method of separating components of crude Oil comprising:

feeding heated crude Oil containing non-readily condensible components and LSR naptha and heavy naphtha components to a tower operating at a relatively high pressure and a relatively high temperature;

separating the crude Oil into an overhead stream, containing essentially all of the non-readily condensible components and essentially all of the LSR naphtha component, a bottoms stream and one or more side streams containing essentially all of the heavy naphtha component in the tower at the relatively nigh pressure and the relatively high temperature;

feeding said bottoms stream to an atmospheric crude distillation unit operating at relatively low pressure;

separating said bottoms stream into a crude distillation unit overhead stream, a crude distillation unit bottoms stream, and one or more crude distillation unit side streams;

collecting a sidestream from the tower at a sidestreams outlet;

feeding said sidestream to a stripper column;

feeding an overhead vapor from the stripper column to a side inlet of the tower;

collecting a bottoms stream from said stripper column as heavy naphtha;

feeding the bottoms stream from the tower to a means for heating so that the lighter components of said bottoms stream are vaporized prior to being fed to the crude distillation unit operating at relatively low pressure;

feeding said bottoms stream into said atmospheric crude distillation unit at a crude feed inlet located at a point above a steam feed inlet;

separating the bottoms stream from the tower into components in the atmospheric crude distillation unit;

collecting a reduced crude product as the crude distillation unit bottoms stream;

feeding the crude distillation unit overhead stream to a pair of condensing units connected in series wherein the second of said pair of condensing units is a total condensing unit and the first of said pair of condensing units is a partial condensing unit;

feeding at least part of a petroleum condensate from the first of said pair of condensing units to an overhead reflux inlet of the atmospheric crude tower;

collecting the remainder of the petroleum condensate from the first of said pair of condensing units as a heavy naphtha product;

feeding the vapor from the first of said pair of condensing units to the second of said pair of condensing units; and feeding a petroleum condensate from the second of said pair of condensing units to the stripper column.

2. The method of claim 1 wherein the tower is maintained at a pressure between approximately 50 and 100 psig.

3. The method of claim 1 wherein the tower is maintained at a pressure between approximately 75 and 85 psig.

4. The method of claim 2, 3, or 1 wherein the heated crude oil is fed to the tower at a pressure between approximately 50 and 100 psig.

5. The method of 2, 3 or 1 wherein the heated crude oil is fed to the tower at a pressure between approximately 75 and 85 psig.

6. The method of claim 1 further comprising the steps of:

feeding the overhead stream from said tower to a second pair of partial condensing units connected in series;

feeding the petroleum condensate from a first partial condensing unit of said second pair to a reflux inlet of the tower;

feeding a vapor from the first partial condensing unit of said second pair to the second partial condensing unit of said second pair;

collecting a petroleum condensate from the second of said partial condensing units of said second pair as light straight run naphtha; and feeding a vapor from the second of said partial condensing units of said second pair to a fuel gas system.

7. The method of claim 1 wherein the tower is maintained at a pressure higher than the pressure of the fuel gas system.

8. The method of claim 6 further comprising the step of separating sour water from the petroleum condensates in each of the condensing units of said second pair of partial condensing units.

9. The method of claim 1 further comprising the step of separating sour water from the petroleum condensate in each of the condensing units of said pair of condensing units.

10. The method of claim 1 further comprising the steps of:

collecting side streams from the atmospheric crude distillation unit at points above the crude feed inlet of said atmospheric crude distillation unit;

feeding said side streams from the atmospheric crude distillation unit to one or more side stream product strippers;

feeding the overheads from said side stream product strippers to side stream inlets of the atmospheric crude distillation unit located at points above the crude feed inlet of said atmospheric crude distillation; and collecting a bottoms stream from each of said side stream product strippers as petroleum products.

11. A method for separating components of crude oil comprising:

feeding heated crude oil containing non-readily condensible components and LSR naptha and heavy naphtha components to a tower operating at a pressure between approximately 75 and 85 psig and at a relatively high temperature;

separating the crude oil into an overhead stream containing essentially all of the non-readily condensible components and essentially all of the LSR naphtha component, a bottoms stream and one or more side streams containing essentially all of the heavy naphtha component in the tower;

feeding the overhead stream from the tower to a pair of partial condensing unit connected in series;

feeding a petroleum condensate from the first partial condensing unit of said pair to a reflux inlet of said tower;

feeding a vapor from the first partial condensing unit to the second partial condensing unit of said pair;

collecting a petroleum condensate from the second of said partial condensing units of said pair as light straight run naphtha product;

feeding a vapor from the second of said partial condensing units to a fuel gas system;

collecting a side stream from the tower at a side stream outlet;

feeding said side stream to a stripper column;

feeding an overhead vapor from said stripper column to a side inlet of said tower;

collecting a bottoms stream from said stripper column as heavy naphtha product;

feeding the bottoms stream from the tower to a means for heating so that the lighter components of said bottoms stream are vaporized;

feeding said bottoms stream from the means for heating to an atmospheric crude distillation unit having a crude feed inlet and a steam feed inlet, said crude feed inlet located at a point above said steam feed inlet;

separating the bottoms stream from the tower into components in the atmospheric crude distillation unit;

collecting a reduced crude product as a bottoms stream from said atmospheric crude distillation unit;

feeding an overhead stream from said atmospheric crude distillation unit to a second pair of condensing units connected in series wherein the second of said second pair of condensing units is a total condensing unit in the first of said second pair is a partial condensing unit;

feeding at least part of a petroleum condensate from the first of said second pair of condensing units to an overhead reflux inlet of the atmospheric crude distillation unit; p1 collecting the remainder of the petroleum condensate from the first of said second pair of condensing units as heavy naphtha product;

feeding a vapor from the first of said second pair of condensing units to the second of said second pair of condensing units;

feeding a petroleum condensate from the second of said second pair of condensing units to the stripper column;

collecting side streams from the atmospheric crude distillation unit at point above the crude feed inlet said atmospheric crude distillation unit;

feeding said side streams from the atmospheric crude distillation unit to one or more side stream products strippers;

feeding the overheads from said side stream product strippers to side stream inlets of the atmospheric crude distillation unit located at points above the crude feed inlet of said atmospheric crude distillation unit;

collecting a bottoms stream from each of said side stream product strippers as petroleum products; and separating sour water from the petroleum condensate in each of the condensing units of each of said first and second pair of condensing units.

* * * * *